US012156581B2

(12) United States Patent
Kuga

(10) Patent No.: US 12,156,581 B2
(45) Date of Patent: Dec. 3, 2024

(54) BAR-SHAPED COSMETIC MATERIAL FEEDING CONTAINER

(71) Applicant: TOKIWA CORPORATION, Nakatsugawa (JP)

(72) Inventor: Wataru Kuga, Kawaguchi (JP)

( * ) Notice: Subject to any disclaimer, the term of this patent is extended or adjusted under 35 U.S.C. 154(b) by 28 days.

(21) Appl. No.: 18/058,733

(22) Filed: Nov. 24, 2022

(65) Prior Publication Data

US 2023/0157436 A1 May 25, 2023

(30) Foreign Application Priority Data

Nov. 25, 2021 (JP) ..... 2021-191138

(51) Int. Cl.
*A45D 40/06* (2006.01)
*A45D 40/10* (2006.01)
*A45D 40/20* (2006.01)

(52) U.S. Cl.
CPC ..... *A45D 40/06* (2013.01); *A45D 40/10* (2013.01); *A45D 40/20* (2013.01); *A45D 2200/05* (2013.01)

(58) Field of Classification Search
CPC ..... A45D 40/205; A45D 40/04; A45D 40/06; A45D 2040/208; B43K 21/08; B43K 21/085
See application file for complete search history.

(56) References Cited

U.S. PATENT DOCUMENTS

| | | | | |
|---|---|---|---|---|
| 7,455,467 | B2 * | 11/2008 | Sasaki | B43L 23/00 401/75 |
| 10,299,564 | B2 * | 5/2019 | Ishida | A45D 40/12 |
| 2011/0206443 | A1 | 8/2011 | Ishida | |
| 2015/0335134 | A1 | 11/2015 | Jouan et al. | |

FOREIGN PATENT DOCUMENTS

| | | |
|---|---|---|
| CN | 102166062 | 8/2011 |
| CN | 102960936 | 3/2013 |
| JP | 2018-175244 | 11/2018 |
| KR | 101923187 | 11/2018 |
| WO | 01/007338 | 2/2001 |

OTHER PUBLICATIONS

JP-2018-175244-A Machine Translation (Year: 2018).*
Xiaozhu Wang et al., "Mechanical Design", Beijing Institute of Technology Press, Apr. 30, 2017, P341 with English partial translation.

* cited by examiner

*Primary Examiner* — David P Angwin
*Assistant Examiner* — Bradley S Oliver
(74) *Attorney, Agent, or Firm* — SOEI PATENT & LAW FIRM

(57) ABSTRACT

A bar-shaped cosmetic material feeding container includes a front tube, an inner tube arranged inside the front tube and forming an opening to dispense a bar-shaped cosmetic material, a screw member that is rotatable relative to the front tube, a moving body that is accommodated inside the inner tube and that includes a core chuck for gripping the bar-shaped cosmetic material. The inner tube is movable in the axial direction through an opening of the front tube. The moving body is coupled to the screw member to move the bar-shaped cosmetic material in the axial direction through the opening of the inner tube. The feeding container further includes a first spring to buffer a movement of the inner tube, and a second spring to buffer a movement of the core chuck of the moving body, that has a spring constant different from a spring constant of the first spring.

16 Claims, 26 Drawing Sheets

BAR-SHAPED COSMETIC MATERIAL FEEDING CONTAINER

CROSS-REFERENCE TO RELATED APPLICATIONS

This application claims the benefit of priority from Japanese Patent Application No. 2021-191138, filed Nov. 25, 2021, the entire contents of which are incorporated herein by reference.

BACKGROUND

In using a bar-shaped cosmetic material having a small core diameter in a bar-shaped cosmetic material feeding container, the bar-shaped cosmetic material may be easily broken when drawn on a to-be coated portion. In the bar-shaped cosmetic material feeding container, a technique may be applied for preventing the bar-shaped cosmetic material from breaking due to an impact such as falling of the container, as described for example in Japanese Unexamined Patent Publication No. 2018-175244.

In Japanese Unexamined Patent Publication No. 2018-175244, two springs are accommodated in a container, and when the container falls from, for example, a distal end direction, a bar-shaped cosmetic material holding unit for holding the bar-shaped cosmetic material moves in the distal end direction of an axial line, the spring on a distal end side is compressed while the spring on a rear end side is expanded, an impact from the fall is buffered due to the compression and expansion of the two springs, and core breakage due to the impact of the bar-shaped cosmetic material can be prevented. Further, when the container falls from, for example, a rear end direction, the bar-shaped cosmetic material holding unit for holding the bar-shaped cosmetic material moves in the rear end direction of the axial line, the spring on the distal end side is expanded while the spring on the rear end side is compressed, the impact is buffered by the expansion and compression of the two springs, and the core breakage due to the impact of the bar-shaped cosmetic material can be prevented.

As described above, in Japanese Unexamined Patent Publication No. 2018-175244, the core breakage of the bar-shaped cosmetic material according to the falling or the like can be prevented, however the material feeding container may not prevent the core breakage especially when drawing with the bar-shaped cosmetic material having a small core diameter.

SUMMARY

The present disclosure is summarized in [1] to [7].

[1] A bar-shaped cosmetic material feeding container according to an example includes: a front tube having an opening at the tip (or front end), a female screw member provided with a female screw in an inside and rotatable relative to the front tube, a moving body provided with a male screw screwable with the female screw of the female screw member on an outer surface and provided with a core chuck at a distal end for gripping (or holding) a bar-shaped cosmetic material, and a pipe member (or inner tube) arranged inside the front tube to be movable in an axial direction with respect to the front tube and rotatable synchronously around an axial line (also referred to herein as rotation axis or longitudinal axis) to protrude from the opening of the front tube, in which the moving body is accommodated inside the pipe member to be movable in the axial direction and rotatable synchronously around the axial line, in which the opening that allows the bar-shaped cosmetic material to appear or disappear is provided at a distal end of the pipe member, and in which the bar-shaped cosmetic material feeding container includes a first spring buffering the pipe member and a second spring having a spring constant different from that of the first spring and buffering the core chuck.

According to such a bar-shaped cosmetic material feeding container in [1], when the bar-shaped cosmetic material is pressed against a to-be coated portion (e.g., a surface to be coated) in a case where the bar-shaped cosmetic material protrudes from the pipe member, drawing can be performed on the to-be coated portion while the bar-shaped cosmetic material gripped by the core chuck retracts by the second spring and the bar-shaped cosmetic material is protected. When the distal end of the bar-shaped cosmetic material retreats or is consumed for coating and is flush with the distal end of the pipe member and the pipe member is pressed against the to-be coated portion in a state where the bar-shaped cosmetic material does not protrude from the opening of the pipe member, since the to-be coated portion is depressed and curved in a slightly concave state, the distal end of the bar-shaped cosmetic material is allowed to hit (or reach, e.g., contact) the to-be coated portion. And, the pipe member allowed to hit around the to-be coated portion retreats while retracting the first spring, and drawing can be performed on the to-be coated portion while the bar-shaped cosmetic material protruding from the pipe member retracts the second spring and the bar-shaped cosmetic material is protected. When the drawing is completed and the bar-shaped cosmetic material feeding container is separated from the to-be coated portion, the first spring is expanded due to the biasing force, and thus the pipe member advances and returns to the original position. And, the second spring is expanded due to the biasing force, and thus, the bar-shaped cosmetic material advances.

Therefore, as drawing and consumption are made, the distal end of the bar-shaped cosmetic material is located at a position that is retreated from the original position. When the distal end of the bar-shaped cosmetic material is drawn too much and is retreated so as to be hidden in the pipe member, the bar-shaped cosmetic material gripped by the core chuck is fed by the relative rotation of the front tube and the female screw member, and the distal end of the bar-shaped cosmetic material is flush with or protrudes from the distal end of the pipe member. Therefore, drawing can be performed on the to-be coated portion as bar-shaped cosmetics, particularly, bar-shaped cosmetics having a small core diameter should not excessively protrude from the pipe member, so as to prevent the core breakage during drawing. Further, since drawing can be performed even in a state where the bar-shaped cosmetic material does not protrude from the opening of the pipe member in this manner, the bar-shaped cosmetic material feeding container is more convenient to use than other bar-shaped cosmetic material feeding containers.

[2] The above-mentioned functions according to the container of [1] may be provided by a configuration in which a container body having a shape of a bottomed cylinder (e.g., a cylinder having a closed end and an open end) that is attached to the front tube so as to be relatively rotatable is provided, and the container body accommodates a female screw member inside and is engaged with the female screw member so as to be rotatable synchronously around the axial line.

[3] The above-mentioned functions according to the container of [1] may be provided by a configuration in which the female screw member is accommodated in the front tube, and a rear end portion of the female screw member is used as a relative rotating portion which protrudes outward in an axial direction from a rear end portion of the front tube and is relatively rotatable with the front tube.

[4] Further, according to the container of any one of [1] to [3], when a spring constant of the second spring is larger (greater) than a spring constant of the first spring, the functions of the first spring and the second spring can be suitably realized.

[5] Further, according to the container of any one of [1] to [4], when at least one of the first spring and the second spring is integrally formed with the female screw member, the number of components can be reduced.

[6] Further, according to the container of any one of [1] to [5], a distal end portion of the pipe member may be provided with an inclined portion (or front end surface) that is inclined with respect to the axial direction. In a case where such a configuration is adopted, when the bar-shaped cosmetic material feeding container faces the to-be coated portion at an angle, since the distal end portion of the pipe member is an inclined portion, the distal end of at least the bar-shaped cosmetic material of the bar-shaped cosmetic material and the pipe member is allowed to easily hit (or reach e.g., contact) the to-be coated portion, and since a component force in the axial direction acts on at least the bar-shaped cosmetic material of the bar-shaped cosmetic material and the pipe member, similarly to the case where the distal end portion perpendicular to the axial direction of the pipe member confronts the to-be coated portion, drawing can be performed while at least the bar-shaped cosmetic material of the bar-shaped cosmetic material and the pipe member is appropriately retracted.

[7] In addition, according to the container of any one of [1] to [6], when the rear portion of the front tube and the female screw member are covered from the rear side and accommodated inside, and a holder tube having a bottomed cylindrical shape rotatable synchronously with the female screw member is provided, since drawing can be performed with the holder tube held by hand, the usability with easier drawing can be achieved.

As described above, according to the present disclosure, the core breakage during drawing with a bar-shaped cosmetic material having a small core diameter can be prevented, and a bar-shaped cosmetic material feeding container that is more convenient to use can be provided.

DETAILED DESCRIPTION

In the following description, with reference to the drawings, the same reference numbers are assigned to the same components or to similar components having the same function, and overlapping description is omitted.

Figure 1:
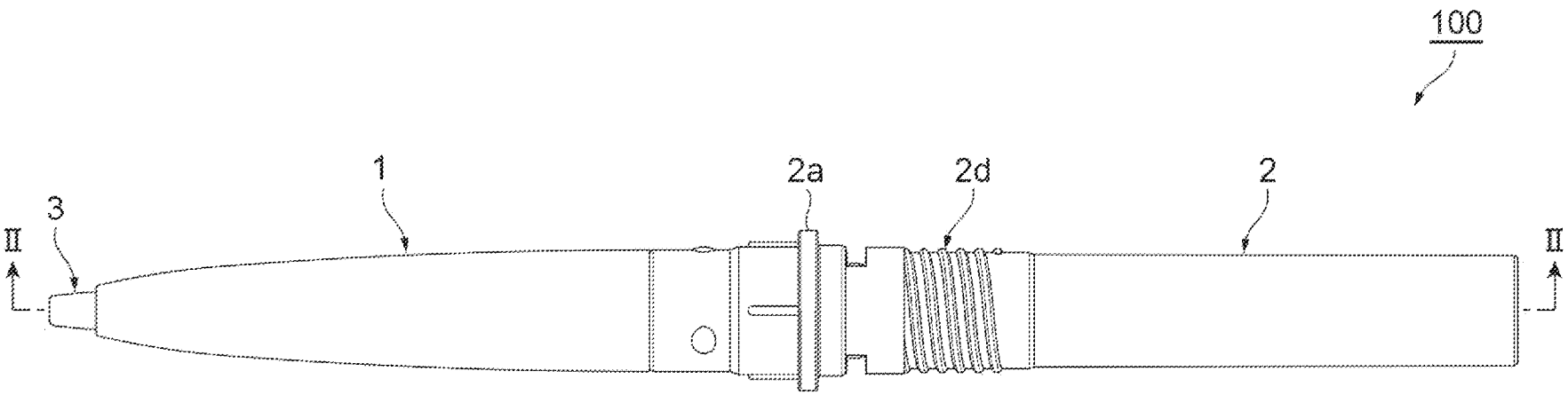
FIG. 1 is a side view illustrating a bar-shaped cosmetic material feeding container according to an example.
Figure 2:
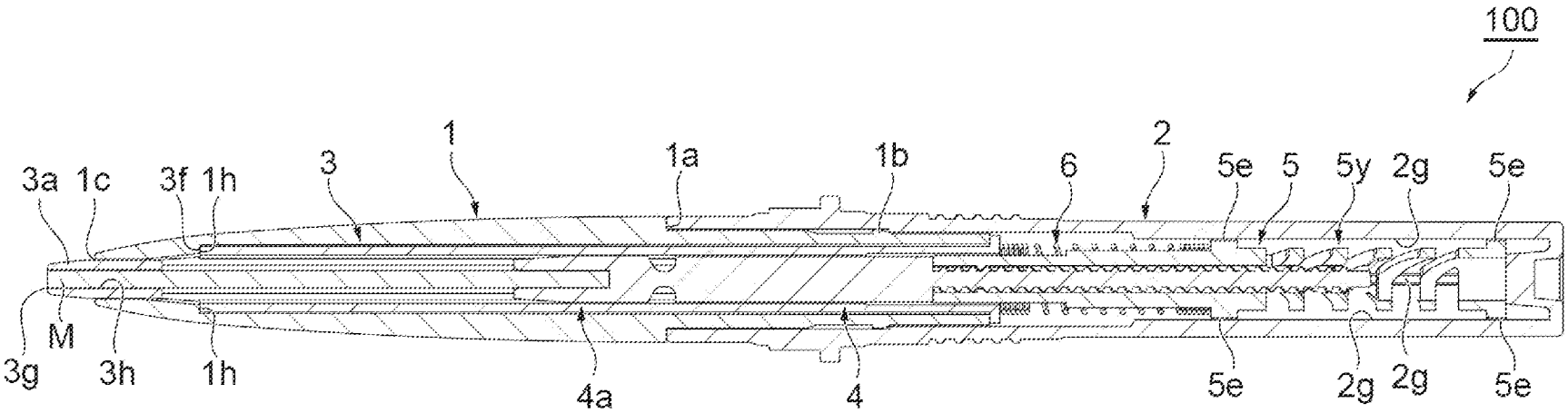
FIG. 2 is a cross-sectional view taken along a line II-II in FIG. 1.
Figure 3:
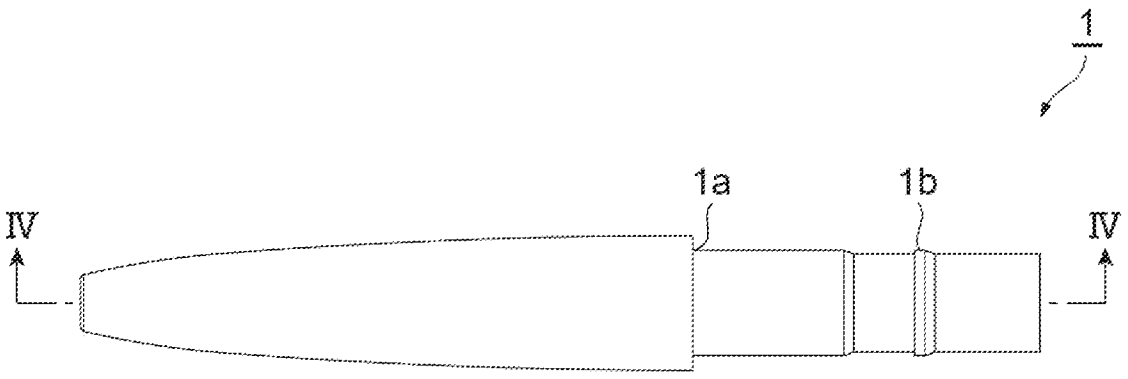
FIG. 3 is a side view illustrating a front tube of the feeding container in FIGS. 1 and 2.
Figure 4:
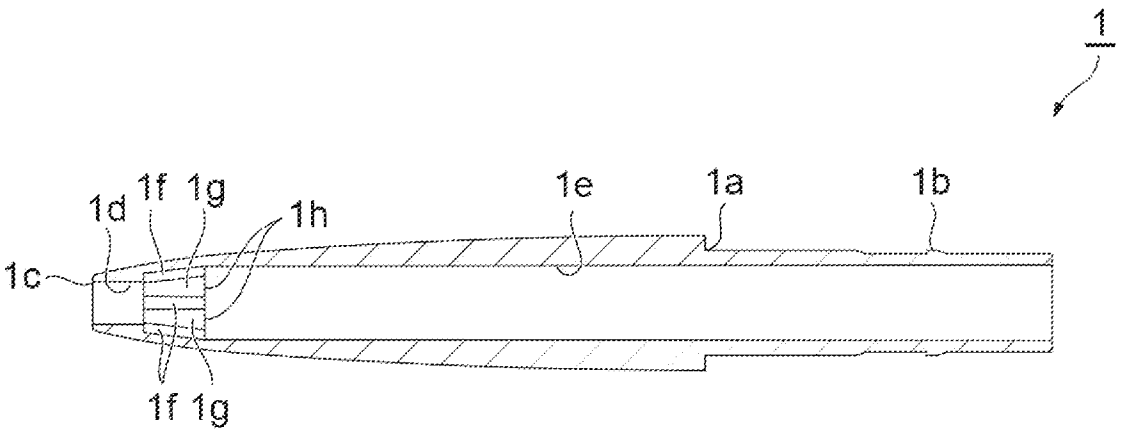
FIG. 4 is a cross-sectional view taken along a line IV-IV in FIG. 3.
Figure 5:
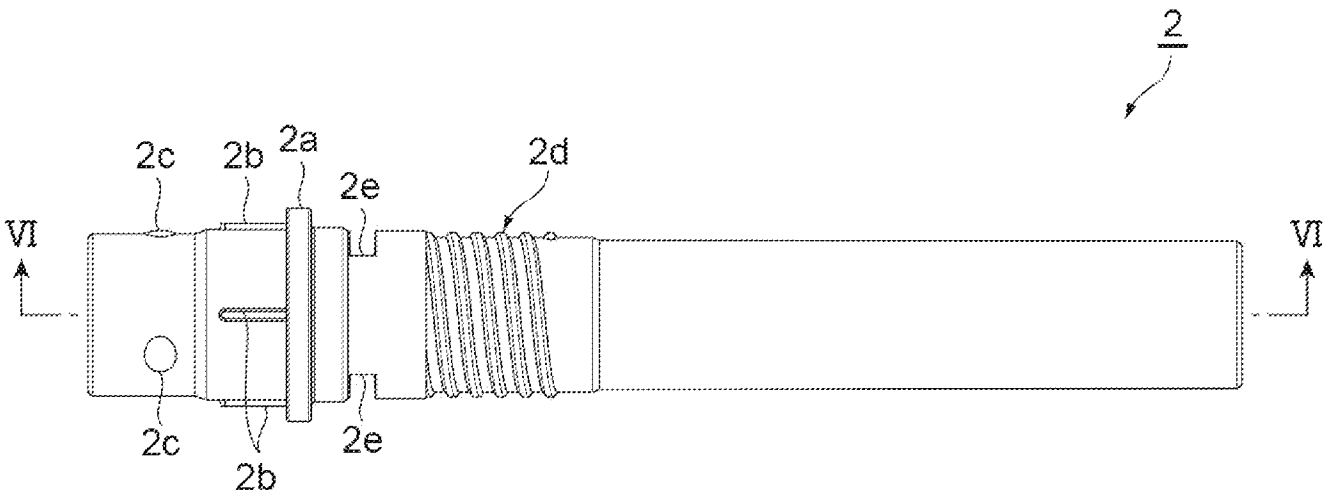
FIG. 5 is a side view illustrating a container body of the feeding container in FIGS. 1 and 2.
Figure 6:
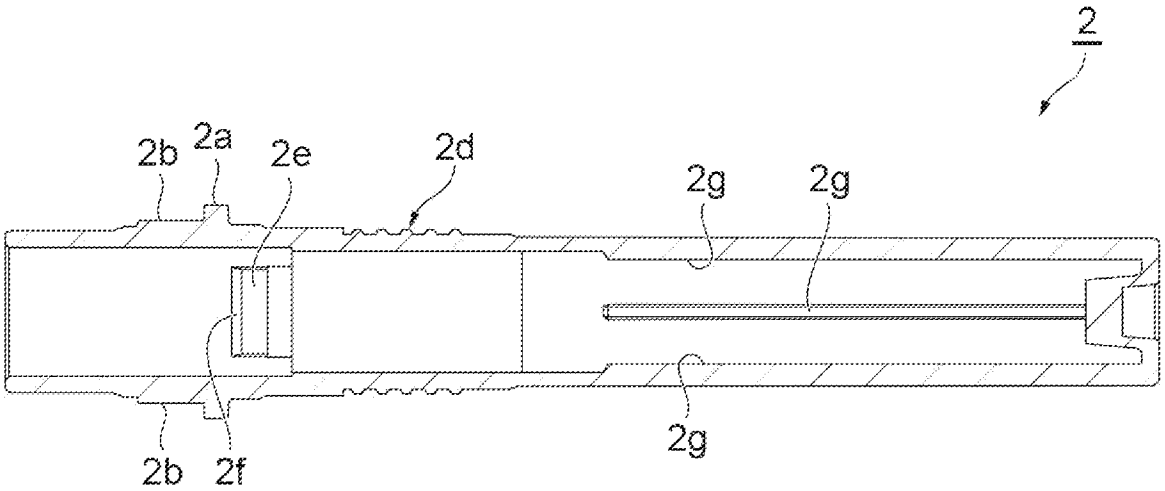
FIG. 6 is a cross-sectional view taken along a line VI-VI in FIG. 5.
Figure 7:
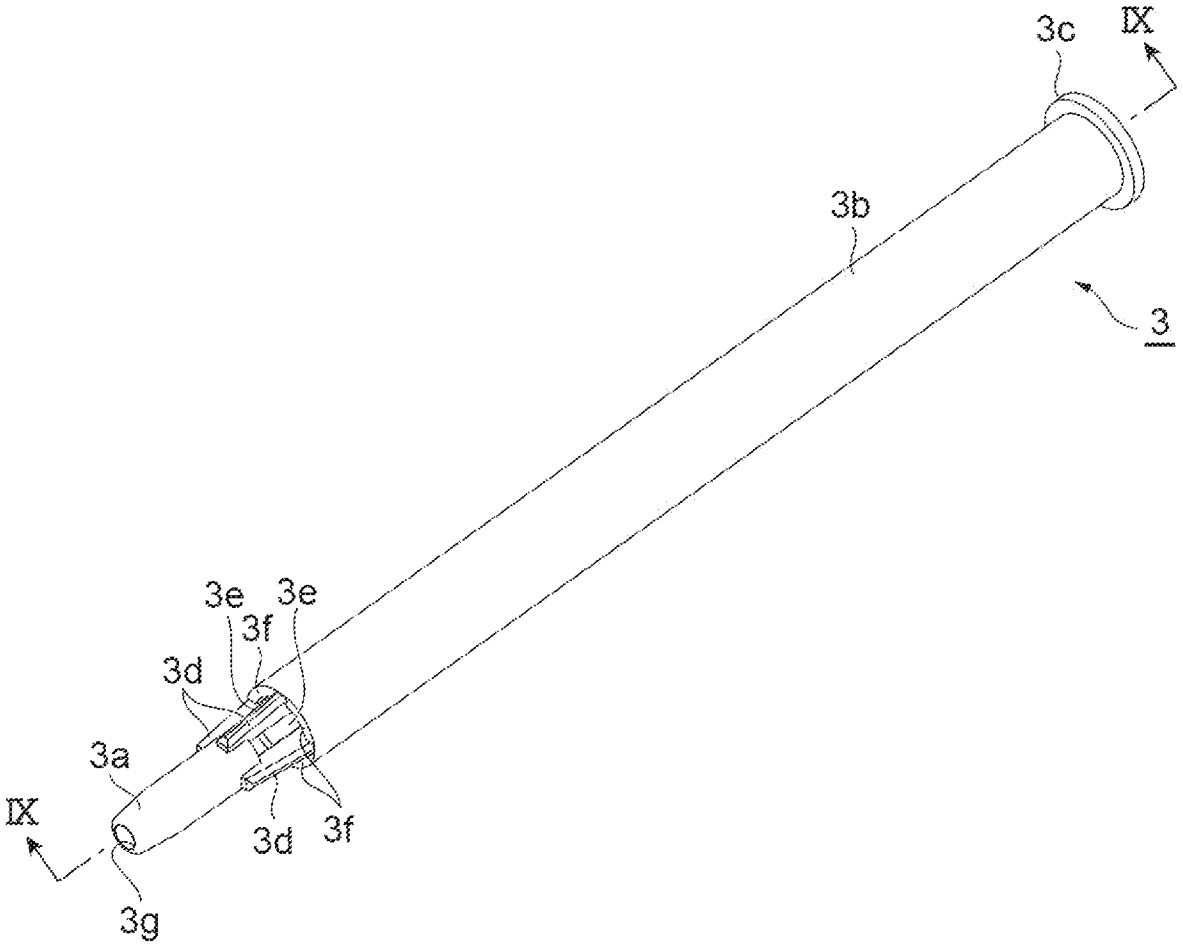
FIG. 7 is a perspective view illustrating a pipe member of the feeding container in FIGS. 1 and 2.
Figure 8:
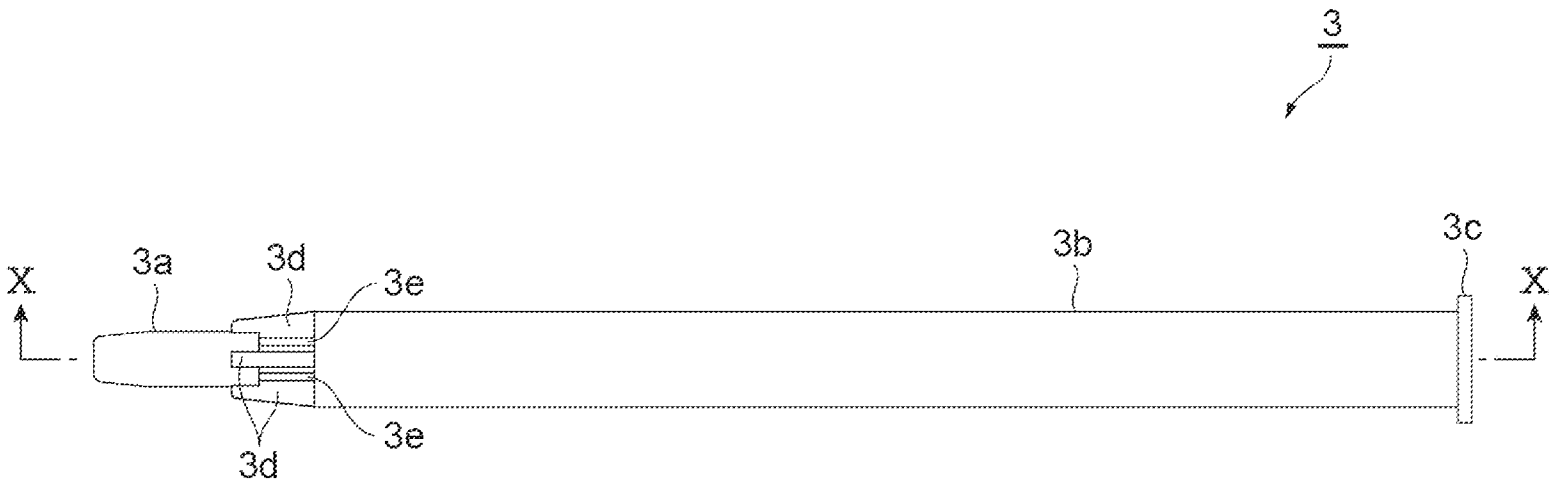
FIG. 8 is a side view of the pipe member illustrated in FIG. 7.
Figure 9:
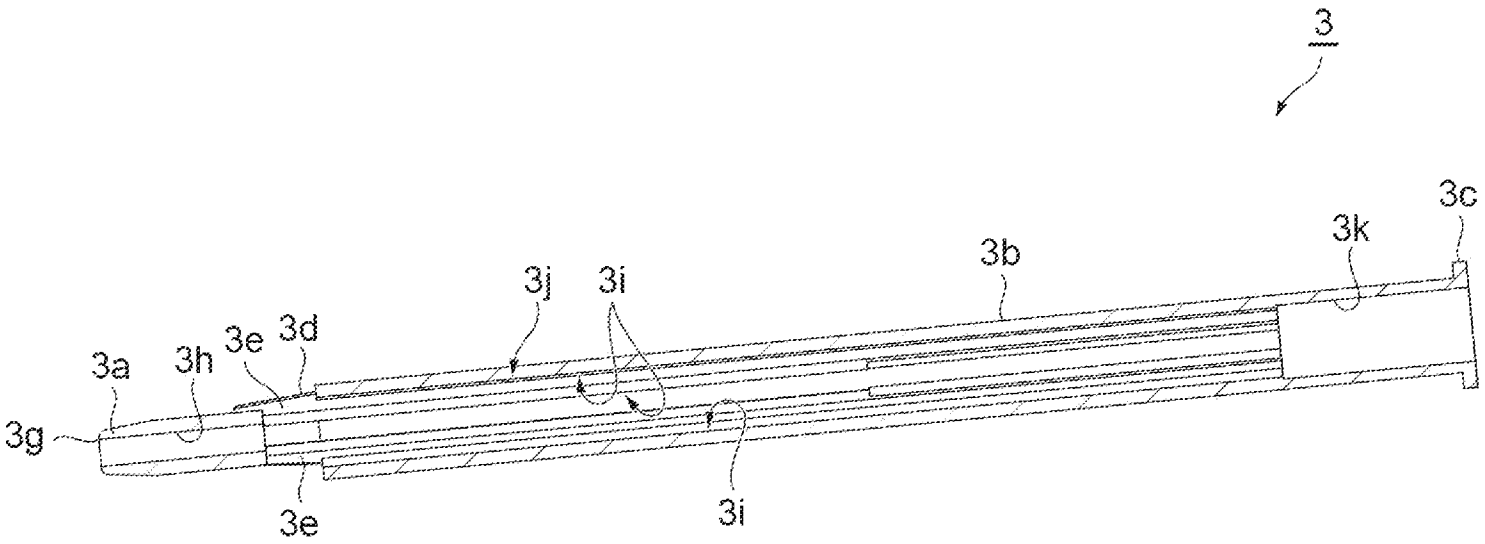
FIG. 9 is a cross-sectional view taken along a line IX-IX in FIG. 7.
Figure 10:
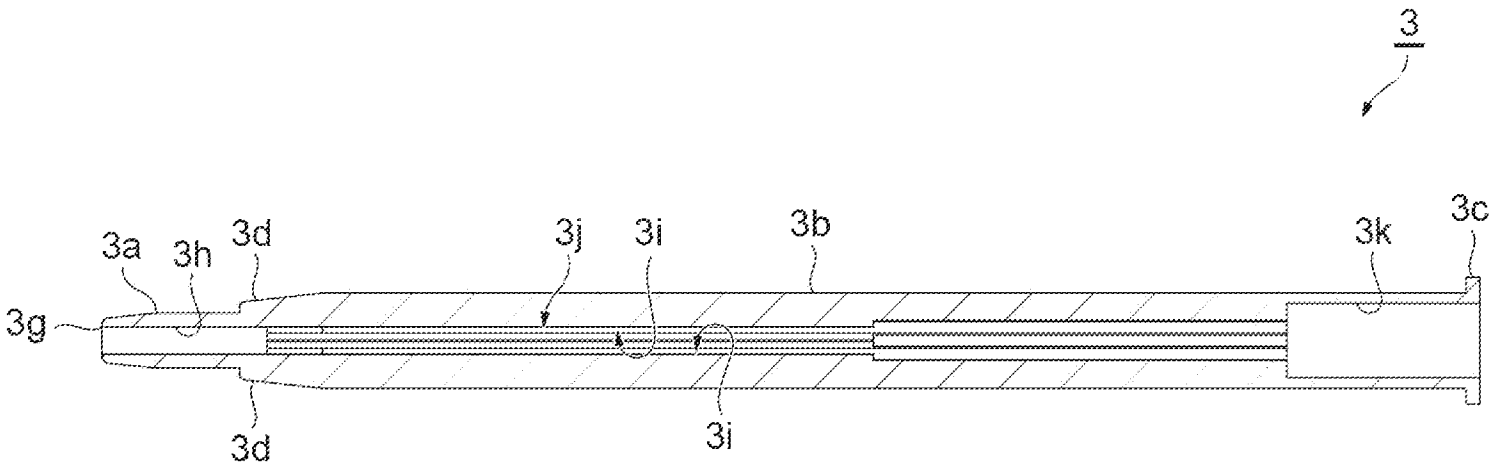
FIG. 10 is a cross-sectional view taken along a line X-X in FIG. 8.
Figure 11:
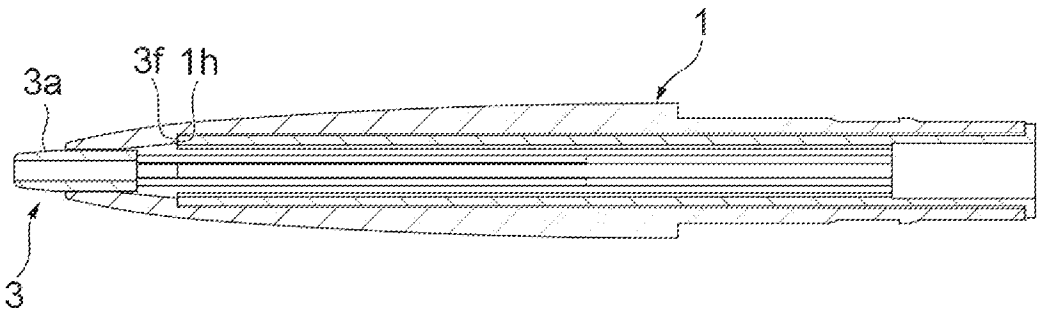
FIG. 11 is an assembled cross-sectional view of the front tube and the pipe member in FIG. 2.
Figure 12:
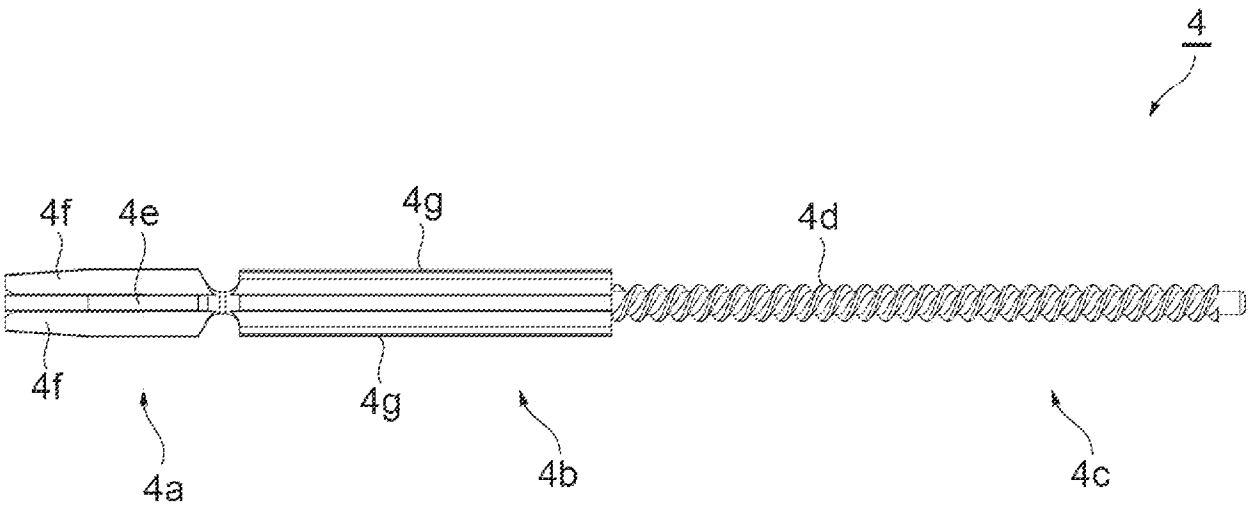
FIG. 12 is a side view illustrating a moving body in FIG. 2.
Figure 13:
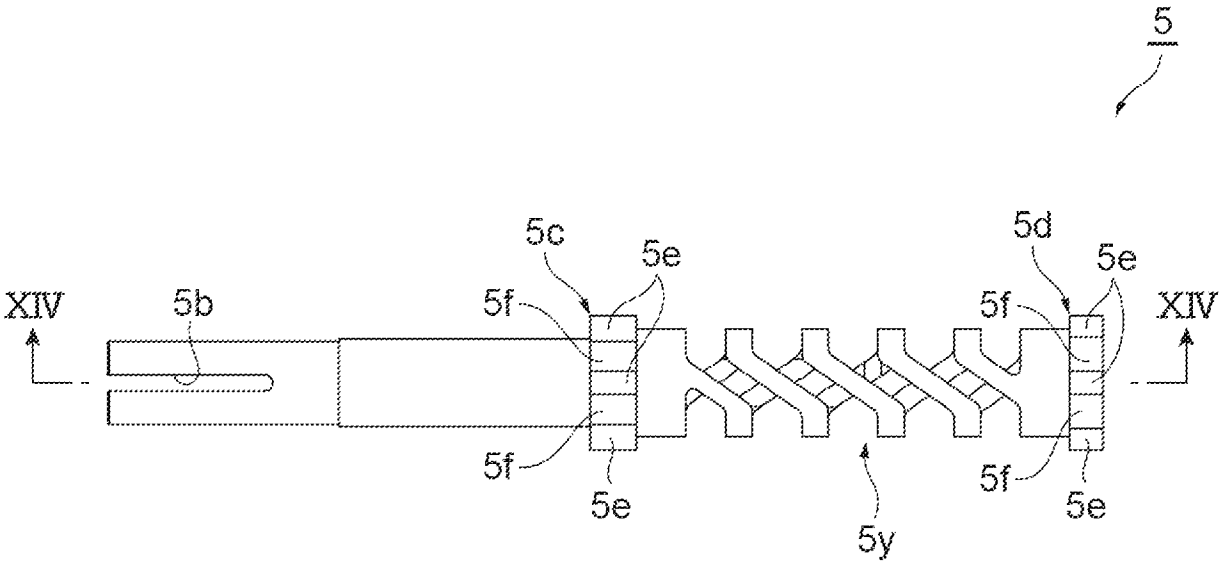
FIG. 13 is a side view of a female screw member of the feeding container in FIG. 2, illustrated with a first spring removed.
Figure 14:
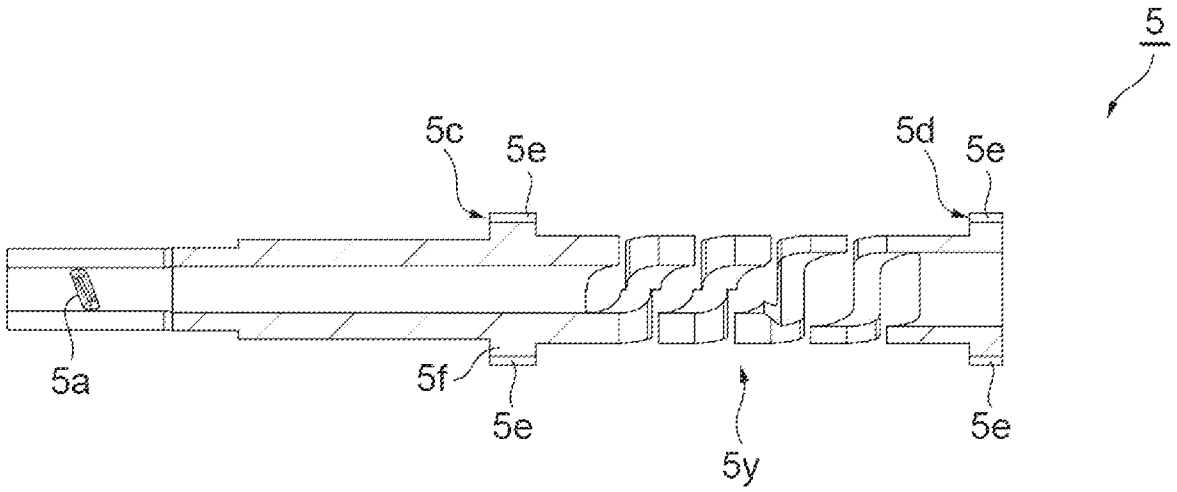
FIG. 14 is a cross-sectional view taken along a line XIV-XIV in FIG. 13.
Figure 15:
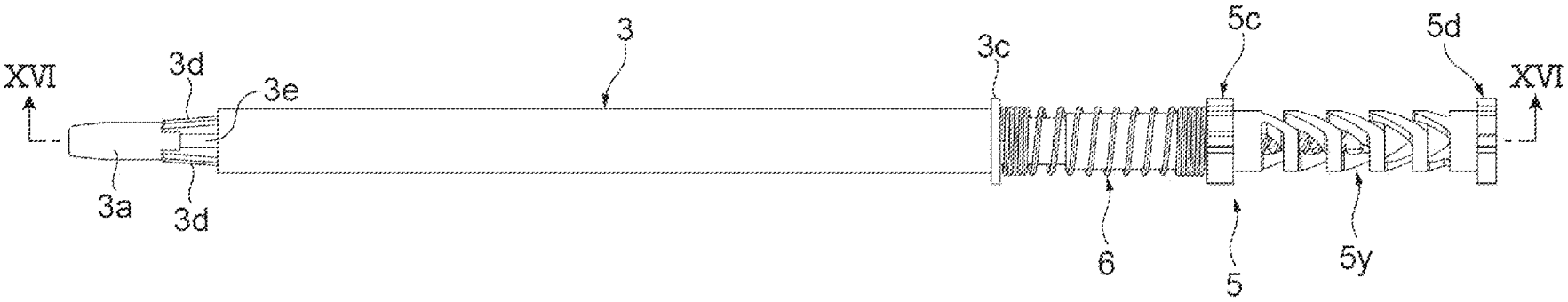
FIG. 15 is an assembled side view of the pipe member and the female screw member in FIG. 2.
Figure 16:
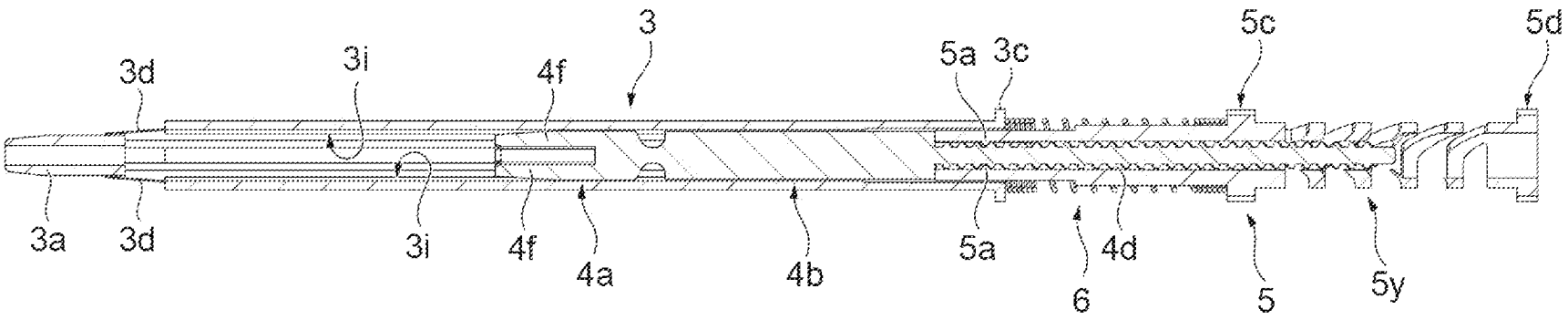
FIG. 16 is a cross-sectional view taken along a line XVI-XVI in FIG. 15.

FIGS. 1 and 2 illustrate a bar-shaped cosmetic material feeding container according to an example, FIGS. 3 and 4 illustrate a front tube, FIGS. 5 and 6 illustrate a container body, FIGS. 7 to 10 are views illustrating a pipe member (or inner tube), FIG. 11 is an assembled cross-sectional view of the front tube and the pipe member, FIG. 12 is a side view illustrating a moving body, FIGS. 13 and 14 are views in which a first spring of a female screw member is removed, and FIGS. 15 and 16 are assembled views of the pipe member and the female screw member. The bar-shaped cosmetic material feeding container according to the present example is particularly suitable for applying the bar-shaped cosmetic material such as an eyebrow pencil for example, and the like, to a to-be coated portion (e.g., a surface to be coated) such as eyebrows for example, and the like, and is particularly suitable to be applied to the bar-shaped cosmetic material having a small core diameter. It is noted that the bar-shaped cosmetic material is not limited to an eyebrow pencil, and can be applied to, for example, a bar-shaped cosmetic material such as an eyeliner and a lip liner.

As illustrated in FIGS. 1 and 2, a bar-shaped cosmetic material feeding container 100 exhibits an elongated round bar shape like a writing tool as an overall shape and has a front tube 1 on a front side and a container body 2 on a rear side as an external shape. A bar-shaped cosmetic material M and a pipe member (or inner tube) 3 that allow a distal end (or front end) of the bar-shaped cosmetic material M to pass therethrough and are slidable (movable) within a predetermined range in an axial direction are accommodated in the front tube 1. A moving body 4 provided with a core chuck 4*a* to grip (or to hold) the bar-shaped cosmetic material M, a female screw member 5 screwed with the moving body 4, a first spring 6 for buffering the pipe member 3 in the axial direction, and a second spring 5*y* for buffering the core chuck 4*a* and the moving body 4 in the axial direction are accommodated in the front tube 1 and the container body 2, and herein, the second spring 5*y* is included in the female screw member 5.

As illustrated in FIGS. 3 and 4, the front tube 1 has a stepped cylindrical shape including a stepped portion 1*a* on the outer peripheral surface at a middle portion in an axial direction of the front tube 1. A small-diameter cylindrical portion extends from a rear (e.g., rear side) of the stepped portion 1*a* and forms an insertion portion to be inserted into the container body 2. A large-diameter cylindrical portion having a larger diameter than the small-diameter cylindrical portion extends from a front (e.g., front side) of the stepped portion 1*a* and has a tapered shape toward the distal end. The large-diameter cylindrical portion is configured to protrude from the distal end of the container body 2 to form a grip portion for the user during the rotation of the front tube 1 relative to the container body 2.

A convex portion 1*b* for being attached to the container body 2 is provided in an annular shape on the outer peripheral surface on the rear side of the stepped portion 1*a* of the front tube 1.

The front tube 1 is provided with a tubular hole penetrating from an opening 1*c* at the distal end (or front end) to a rear end opposite the distal end, for accommodating the pipe member 3. A small-diameter tubular hole 1*d* is located at the distal end side (or front end portion) of the tubular hole, and a large-diameter tubular hole 1*e* having larger diameter than the small-diameter tubular hole 1*d* extends from the front end portion to the rear end of the front tube 1. At a portion between the small-diameter tubular hole 1*d* and the large-diameter tubular hole 1*e*, having a diameter that increases toward the large-diameter tubular hole 1*e*, concave portions 1*f* are arranged along a circumferential direction and extend substantially in the axial direction of the front tube 1. The concave portions 1*f* correspond to a same diameter as the large-diameter tubular hole 1*e* so as to extend continuously from the large-diameter tubular hole 1*e*. Convex portions 1*g* are formed between the concave portions 1*f* along the circumferential direction, and the concave portions 1*f* and the convex portions 1*g* are intermittently arranged side by side along the circumferential direction. For example, in this case, the front tube 1 includes four concave portions 1*f* and four convex portions 1*g*. The convex portions 1*g* correspond to a same diameter as the small-diameter tubular hole 1*d* so as to extend continuously from the small-diameter tubular hole 1*d*. The concave portions 1*f* and the convex portions 1*g* are for engaging the pipe member 3 in the rotational direction. The rear end face of the convex portion 1*g* is a stepped face 1*h*, and this stepped face 1*h* is the advance limit at which the distal end face of the pipe member 3 abuts (cf. FIG. 2).

As illustrated in FIGS. 5 and 6, the container body 2 has a bottomed cylindrical shape and has a distal end face that abuts against the stepped portion 1*a* of the front tube 1 (cf. FIG. 2). On a front side of a flange portion 2*a* provided on the outer peripheral surface of the container body 2, a plurality of ridges 2*b* (e.g., four in this case) for detachably attaching caps are provided side by side along the circumferential direction, and a plurality of dowels 2*c* are provided in front of the ridges 2*b* along the circumferential direction. A male screw (male screw thread) 2*d* for detachably attaching a holder tube 7 may be provided on the outer peripheral surface of the container body 2 behind the flange portion 2*a*. The holder tube 7 will be described further below, with reference to an example bar-shaped cosmetic material feeding container 200.

A pair of small windows 2*e* that communicate inside and outside are opened to face each other in a tubular portion between the flange portion 2*a* and the male screw 2*d* of the container body 2. In addition, a locking convex portion 2*f* protruding radially outwardly for engaging the convex portion 1*b* of the front tube 1 is provided at a front side of the pair of small windows 2*e* in the axial direction. Further, on the inner peripheral surface of the container body 2, a plurality of ridges 2*g* (e.g., four in this case) extending with an elongated length from the bottom toward the distal end side are provided side by side in equal distributions (e.g., distributed at equal distances) along the circumferential direction to be engaged with the female screw member 5 in the rotational direction.

As illustrated in FIG. 2, the pipe member 3 is inserted into the front tube 1 and also inserts the bar-shaped cosmetic material M and the core chuck 4*a*. As illustrated in FIGS. 7 to 10, the pipe member 3 has a distal end portion 3*a* configured in a cylindrical shape having a small diameter, an elongated cylindrical portion 3*b* having a large diameter is formed behind the distal end portion 3*a*, and a flange portion 3*c* for abutting the first spring 6 is provided at a rear end portion of the cylindrical portion 3*b* (cf. FIG. 2).

A plurality of irregularities (e.g., four in this case) are continuously formed along the circumferential direction between the distal end portion 3*a* and the cylindrical portion 3*b*. A convex portion 3*d* which is flush with the cylindrical portion 3*b*, is inclined radially inwardly toward the distal end side, and extends along a predetermined length. A concave portion 3*e* is a through-hole that communicates inside and outside. The convex portion 3*d* is provided corresponding to the concave portion 1*f* of the front tube 1, and the concave portion 3*e* is provided corresponding to the convex portion 1*g* (cf FIG. 4). Then, a distal end face 3*f* (cf. FIG. 7) of the cylindrical portion 3*b* following a trailing edge of the concave portion (through-hole) 3*e* advances and abuts on the stepped face 1*h* (cf FIG. 4) of the convex portion 1*g* of the front tube 1, so that the advance limit is reached (cf. FIG. 2).

The pipe member 3 is provided with a tubular hole having a circular cross-sectional shape penetrating from an opening 3*g* at the distal end of the distal end portion 3*a* to the rear end. The tubular hole is a bar-shaped cosmetic material hole 3*h* that allows the bar-shaped cosmetic material M to advance and retreat. In the cylindrical portion 3*b*, gripping piece grooves 3*i* for accommodating a gripping piece 4*f* described later of the moving body 4 and being slidable are continuously provided to a plurality of locations (herein, four equally distributed positions) around the bar-shaped cosmetic material hole 3*h*, and an advancing/retreating hole 3*j* in which the bar-shaped cosmetic material M and the gripping piece 4*f* slide is configured by the bar-shaped cosmetic material hole 3*h* and the gripping piece groove 3*i*. It is noted that, in the cylindrical portion 3*b*, the second half of the advancing/retreating hole 3*j* has a larger diameter than the first half (cf. FIGS. 9 and 10), however this is to impart advancing and retreating displacement by a male screw 4*d* (cf. FIG. 12). The male screw 4*d* which will be described later is thicker than the bar-shaped cosmetic material M. Further, a tubular hole 3*k* at the rear end of the cylindrical portion 3*b* is a circular hole having an enlarged diameter and a predetermined length, and this is because the distal end of the female screw member 5 is allowed to enter (cf FIG. 2).

Then, as illustrated in FIG. 11, the pipe member 3 is inserted into the front tube 1, the concave portion 3*e* enters the convex portion 1*g* of the front tube 1, and the convex portion 3*d* enters the concave portion 1*f* of the front tube 1 (cf FIGS. 4 and 7), so that the pipe member 3 is rotatable synchronously (e.g., rotationally fixed) with respect to the front tube 1 and movable in the axial direction. In the state illustrated in FIG. 11, a state is illustrated in which the distal end face 3*f* of the pipe member 3 abuts on the stepped face 1*h* (cf FIG. 4) of the convex portion 1*g* of the front tube 1 and is located at the advance limit.

As illustrated in FIG. 12, the moving body 4 includes the core chuck 4*a* for supporting a rear end portion of the bar-shaped cosmetic material M, a body portion 4*b* on a rear side from the core chuck 4*a*, and a shaft body portion 4*c* on a rear side from the body portion 4*b*. The shaft body portion 4*c* is an elongated shaft body extending backward in the axial direction, and the male screw (or male screw thread) 4*d* screwed with a screw protrusion (or female screw thread) 5*a* as a female screw of the female screw member 5 is provided on the outer peripheral surface of the shaft body portion 4*c* along the axial direction. Accordingly, the male screw thread 4*d* and the female screw thread 5*a* form a screw coupling to operatively engage the moving body 4 with the female screw member 5.

The core chuck 4*a* has a base portion 4*e* for abutting the rear end face of the bar-shaped cosmetic material M, of which outer shape substantially coincides with the outer shape of the bar-shaped cosmetic material M and the gripping piece 4*f* which is provided so as to protrude toward the distal end side at a plurality of positions in the circumferential direction of the outer peripheral surface of the base portion 4*e* (herein, four equally distributed positions) and grips the rear end portions of the bar-shaped cosmetic material M abutted against the base portion 4*e* by interposing the rear end portions between each other. The body portion 4*b* has a convex portion 4*g* extending backward in the axial direction at a position behind of the gripping piece 4*f* so as to be movable in the axial direction similar to that of the gripping piece 4*f* A small diameter portion is formed between the core chuck 4*a* and the body portion 4*b*, so that the core chuck 4*a* is easily bent.

Herein, the female screw member 5 is formed of a resin and is configured in a substantially cylindrical shape as illustrated in FIGS. 13 and 14. The screw protrusions (or female screw thread) 5*a* forming the female screw to be screwed with the male screw 4*d* of the moving body 4 are provided at opposite positions on the inner peripheral surface of the distal end portion of the female screw member 5. A notch 5*b* is provided from the opposite position of the distal end of the female screw member 5 toward the rear. The notch 5*b* is provided at a position where the screw protrusion 5*a* is interposed from the circumferential direction and extends to the rear of the screw protrusion 5*a*, so that a cantilever piece having the screw protrusion 5*a* and having an arcuate shape viewed in the axial direction has a spring property.

Enlarged diameter portions 5*c* and 5*d* are provided at substantially the center and the rear end of the female screw member 5 in the axial direction, a concave portion 5*e* and a convex portion 5*f* are continuously provided in a gear shape at the in-phase four equally distributed positions of the enlarged diameter portions 5*c* and 5*d* in the circumferential direction, and the front and rear concave portions 5*e* and 5*e* are provided so as to be engaged with the ridge 2*g* of the container body 2 in the rotational direction (cf. FIG. 6). The second spring 5*y* as a resin spring having a slit on the peripheral surface and integrally formed in a substantially spiral shape is provided between the enlarged diameter portions 5*c* and 5*d* of the female screw member 5. The first spring 6 (cf FIG. 2) is a coil spring, and the spring constant of the second spring 5*y* which is the resin spring is set to be greater than the spring constant of the first spring 6 which is the coil spring.

Then, as illustrated in FIGS. 15 and 16, the core chuck 4*a* is inserted into a set of the front tube 1 and the pipe member 3 obtained in FIG. 11 (the front tube 1 is omitted in FIGS. 15 and 16). The bar-shaped cosmetic material M is gripped by the core chuck 4*a* in advance. Then, by inserting the gripping piece 4*f* of the core chuck 4*a* into the gripping piece groove 3*i* (cf. FIGS. 9 and 10) of the pipe member 3, the core chuck 4*a* is attached to the front tube 1 and the pipe member 3 to be rotatable synchronously and movable in the axial direction.

In this state, in a state where the first spring 6 is arranged between the rear end face of the flange portion 3*c* of the pipe member 3 and the enlarged diameter portion 5*c* of the female screw member 5, by screwing and tightening the male screw 4*d* of the core chuck 4*a* with the screw protrusion 5*a* and 5*a* of the female screw member 5, the first spring 6 is interposed between the rear end face of the flange portion 3*c* of the pipe member 3 and the enlarged diameter portion 5*c* of the female screw member 5.

Then, as illustrated in FIG. 2, by allowing the ridges 2*g* of the container body 2 to enter the concave portions 5*e* and 5*e* in the front and rear of the female screw member 5, the container body 2 is pushed into the front tube 1, and by allowing the distal end face of the container body 2 to abut on the stepped portion 1*a* of the front tube 1, the locking convex portion 2*f* (cf. FIG. 6) of the container body 2 is engaged with the convex portion 1*b* of the front tube 1 in the axial direction. Therefore, the front tube 1 is attached to the container body 2 so as to be immovable in the axial direction and relatively rotatable around an axial line (also referred to herein as rotational axis or longitudinal axis) of the bar-shaped cosmetic material feeding container 100. In this state, the second spring 5*y* abuts on the bottom of the container body 2.

Further, in this state, the pipe member 3 is biased due to the biasing force of the first spring 6, the distal end face 3*f* of the pipe member 3 abuts on the stepped face 1*h* of the convex portion 1*g* of the front tube 1 to reach the advance limit, and the distal end portion 3*a* of the pipe member 3 is in a state of protruding from the front tube 1 by a predetermined length. Then, herein, the state in which the bar-shaped cosmetic material M is flush with the distal end face of the pipe member 3 is set as the initial state.

As described above, according to the bar-shaped cosmetic material feeding container 100, the front tube 1 having the opening 1*c* at the distal end, the female screw member 5 provided with the screw protrusion 5*a* as a female screw inside and rotatable relative to the front tube 1, the moving body 4 provided with the male screw 4*d* that can be screwed with the screw protrusion 5*a* of the female screw member 5 on the outer surface and provided with the core chuck 4*a* for gripping the bar-shaped cosmetic material M at the distal end, and the pipe member 3 arranged inside the front tube 1, movable in the axial direction with respect to the front tube 1, and protruding from the opening 1*c* of the front tube 1 rotatable synchronously around the axial line are provided. The moving body 4 is accommodated so as to be movable in the axial direction and rotatable synchronously around the axial line inside the pipe member 3, and the opening 3*g* is provided at the distal end of the pipe member 3 so that the bar-shaped cosmetic material M can appear and disappear. The first spring 6 buffering the pipe member 3 and the second spring 5*y* having a different spring constant from the first spring 6 and buffering the core chuck 4*a* are provided.

Therefore, the following functions and effects are exhibited. That is, first, when the distal end of the bar-shaped cosmetic material M is slightly fed out from the initial state illustrated in FIG. 2 and applied to the to-be coated portion, the front tube 1 and the female screw member 5 (substantially, the container body 2) are relatively rotated in the feeding direction of the core chuck 4*a*. Then, when the bar-shaped cosmetic material M is pressed against the to-be coated portion, drawing can be performed on the to-be coated portion while the bar-shaped cosmetic material M gripped by the core chuck 4*a* retracts the second spring 5*y* and the bar-shaped cosmetic material M is protected.

When the distal end of the bar-shaped cosmetic material M retreats or is consumed for coating so as to be flush with the distal end of the pipe member 3, and the pipe member 3 is pressed against the to-be coated portion in a state where the bar-shaped cosmetic material M does not protrude from the opening 3*g* of the pipe member 3, since the to-be coated portion is depressed and curved in a slightly concave state, the distal end of the bar-shaped cosmetic material M may reach (e.g., contact) the to-be coated portion. And, the pipe member 3 allowed to hit around the to-be coated portion retreats while retracting the first spring 6, and drawing can be performed on the to-be coated portion while the bar-shaped cosmetic material M protruding from the pipe member 3 retracts the second spring 5*y* and the bar-shaped cosmetic material M is protected.

Then, when the drawing is completed and the bar-shaped cosmetic material feeding container 100 is separated from the to-be coated portion, the first spring 6 is extended due to the biasing force, and thus, the pipe member 3 is advanced to return to the position of the original advance limit (the position of the distal end face 3*f* abutting on the stepped face 1*h*). And, the second spring 5*y* is expanded due to the biasing force, and thus, the bar-shaped cosmetic material M advances. Therefore, as drawing and consumption are carried out, the distal end of the bar-shaped cosmetic material M is located at a position that is retreated relative to the original position. When the distal end of the bar-shaped cosmetic material M is drawn too much and is retreated so as to be hidden in the pipe member 3, the bar-shaped cosmetic material M gripped by the core chuck 4*a* may be fed out by the relative rotation of the front tube 1 and the female screw member 5 (substantially the container body 2), so that the distal end of the bar-shaped cosmetic material M is flush with or protrudes from the distal end of the pipe member 3.

Therefore, drawing can be performed on the to-be coated portion in a state where the bar-shaped cosmetic material M, particularly the bar-shaped cosmetic material M having a small core diameter does not excessively protrude from the pipe member 3, and the core breakage during the drawing can be prevented. Further, since drawing can be performed even in a state where the bar-shaped cosmetic material M does not protrude from the opening 3*g* of the pipe member 3, the bar-shaped cosmetic material feeding container is more convenient than other bar-shaped cosmetic material feeding containers.

Further, since the container body 2 has a bottomed cylindrical shape and is attached to the front tube 1 so as to be relatively rotatable and the container body 2 accommodates the female screw member 5 inside and is engaged with the female screw member 5 so as to be rotatable synchronously around the axial line, the above-mentioned function can be suitably exerted.

Also, since the spring constant of the second spring 5*y* is greater than the spring constant of the first spring 6, the functions of the first spring 6 and the second spring 5*y* may be more suitably achieved.

Further, since the second spring 5*y* is integrally formed with the female screw member 5, the number of components is reduced.

The bar-shaped cosmetic material M may be incorporated in the bar-shaped cosmetic material feeding container 100 in accordance with, for example, the production process described below. The bar-shaped cosmetic material M to be used is produced to have a length corresponding to the length from the distal end of the front tube 1 (see FIG. 2) to the distal end of the base portion 4*e* of the core chuck 4*a* (see FIG. 12) when incorporated into the bar-shaped cosmetic material feeding container 100. Further, the length in the axial direction between the distal end of the distal end portion 3*a* of the pipe member 3 and the distal end of the front tube 1 referring to FIG. 2 (the length in the axial direction between the opening 3*g* of the pipe member 3 and the opening 1*c* of the distal end of the front tube 1; hereinafter "x") is configured to be the same or shorter than the length in the axial direction between the distal end of the gripping piece 4*f* of the core chuck 4*a* and the distal end of the base portion 4*e* referring to FIG. 12 (see also FIG. 2; hereinafter "y").

Concerning the production process referring to FIG. 2, the bar-shaped cosmetic material M is inserted from the opening 3*g* of the pipe member 3, and in a state where the distal end of the bar-shaped material M protrudes from the distal end of the pipe member 3 by, for example, 1 mm or so, a jig is used to press to fit the bar-shaped cosmetic material M together with the pipe member 3 until the jig abuts against the distal end of the front tube 1. Then, the rear end face of the bar-shaped cosmetic material M abuts with the distal end of the base portion 4*e* of the core chuck 4*a* and is held by the gripping piece 4*f* Thereafter, the jig is removed, and the pipe member 3 returns to the initial position via a forward movement while the bar-shaped cosmetic material M is left in the core chuck 4*a*. Right after incorporating the bar-shaped cosmetic material M with the above-described production process, a space is left between the distal end of the bar-shaped cosmetic material M and the opening 3*g* of the pipe member 3 by a length of x, whereas FIG. 2 illustrates a state where the moving body 4 is thereafter fed and the bar-shaped cosmetic material M is on the same plane level as the plane level of the distal end of the pipe member 3.

If the length x in the axial direction between the distal end of the pipe member 3 and the distal end of the front tube 1 is longer than a length y in the axial direction between the distal end of the gripping piece 4*f* and the distal end of the base portion 4*e*, when the bar-shaped cosmetic material M is pressed from the opening 3*g* of the pipe member 3 using the above-described jig, before the jig abuts with the distal end of the front tube 1, the rear end face of the bar-shaped cosmetic material M may be crushed by abutting against the distal end of the base portion 4*e*. Note even when the length x in the axial direction between the distal end of pipe member 3 and the distal end of the front tube 1 is slightly longer than the length y in the axial direction between the distal end of the gripping piece 4*f* and the distal end of the base portion 4*e*, the bar-shaped cosmetic material may not be crushed depending on softness thereof.

Figure 17:
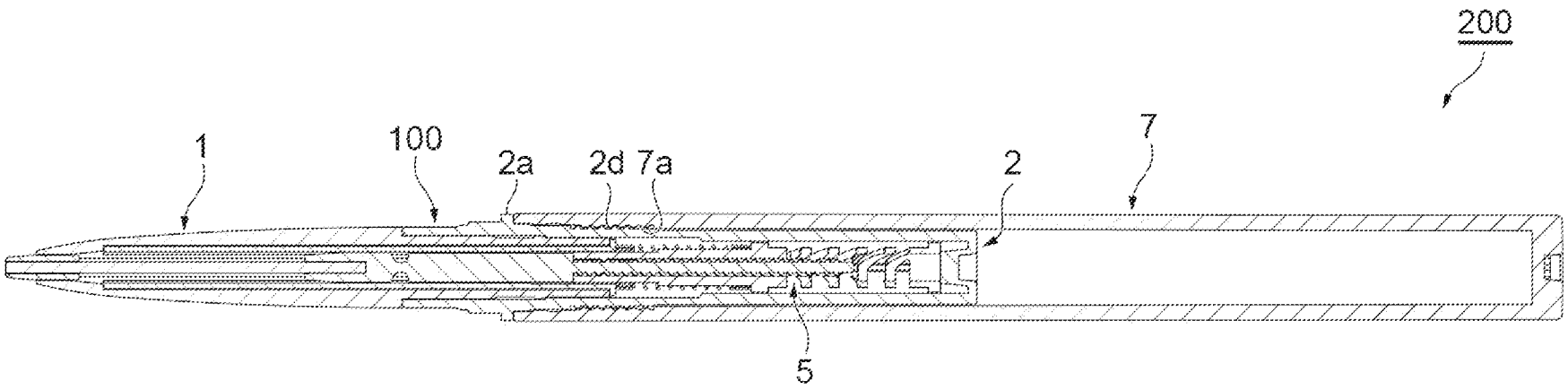
FIG. 17 is a cross-sectional view illustrating a bar-shaped cosmetic material feeding container according to another example.

FIG. 17 is a cross-sectional view illustrating a bar-shaped cosmetic material feeding container according to another example.

In a bar-shaped cosmetic material feeding container 200, the bar-shaped cosmetic material feeding container 100 is used as a so-called bar-shaped cosmetic material cartridge, and the bar-shaped cosmetic material feeding container 200 is configured by detachably (or "not detachably" in other examples) attaching an elongated holder tube 7 having a bottomed cylindrical shape to accommodate the container body 2 constituting the bar-shaped cosmetic material cartridge.

The bar-shaped cosmetic material feeding container 200 is configured by screwing of a female screw 7*a* formed on the inner peripheral surface of the distal end portion of the holder tube 7 with the male screw 2*d* (cf FIGS. 5 and 6) formed on the outer peripheral surface behind the flange portion 2*a* of the container body 2.

According to the bar-shaped cosmetic material feeding container 200, since drawing can be performed with the holder tube 7 held by hand, the usability with easier drawing can be achieved. It is noted that the holder tube 7 may accommodate (or cover) the rear portion of the front tube 1 and the female screw member 5 from the rear side and may have a bottomed cylindrical shape that is rotatable synchronously (e.g., rotationally fixed) with the female screw member 5. For example, the cylindrical portion of the container body 2 may be further extended with an elongated length backward to be used as the holder tube 7.

Figure 18:
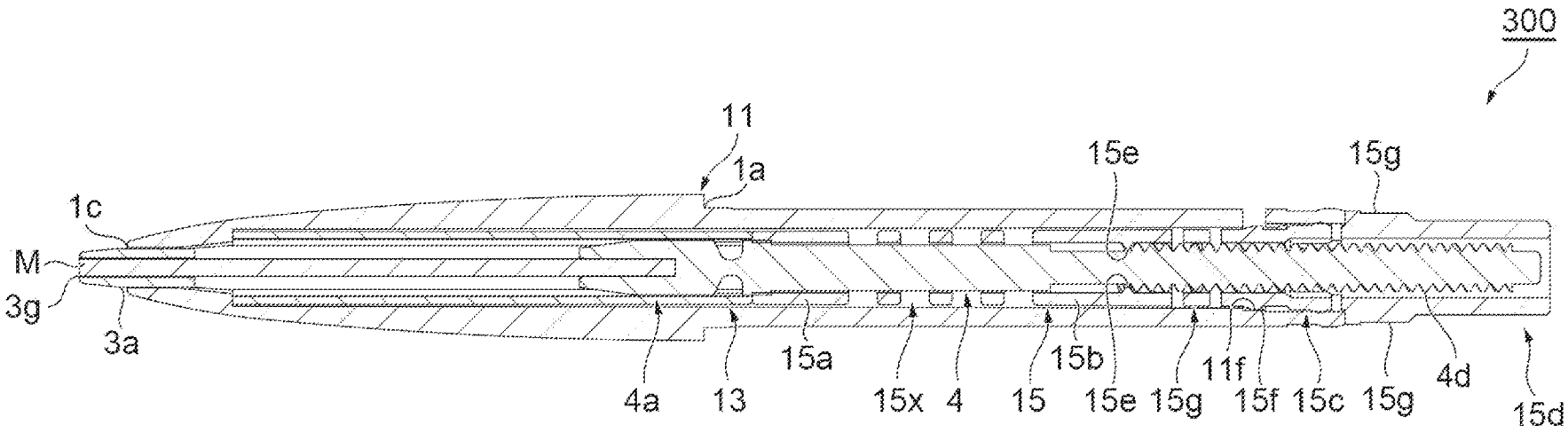
FIG. 18 is a cross-sectional view illustrating a bar-shaped cosmetic material feeding container according to another example.
Figure 19:
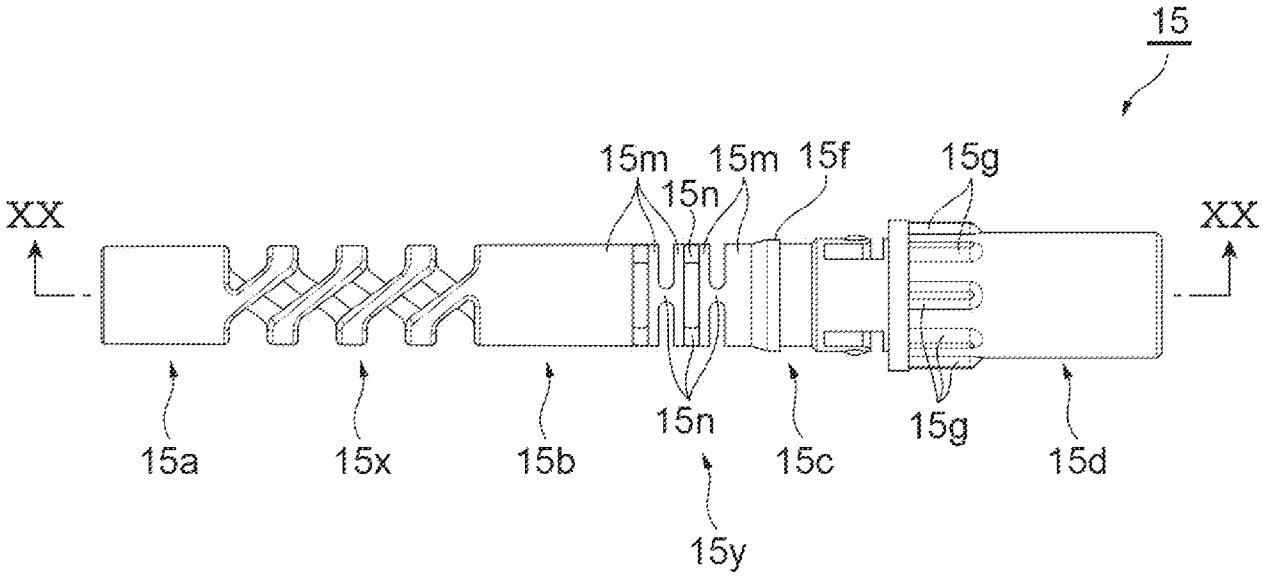
FIG. 19 is a side view illustrating a female screw member in FIG. 18.
Figure 20:
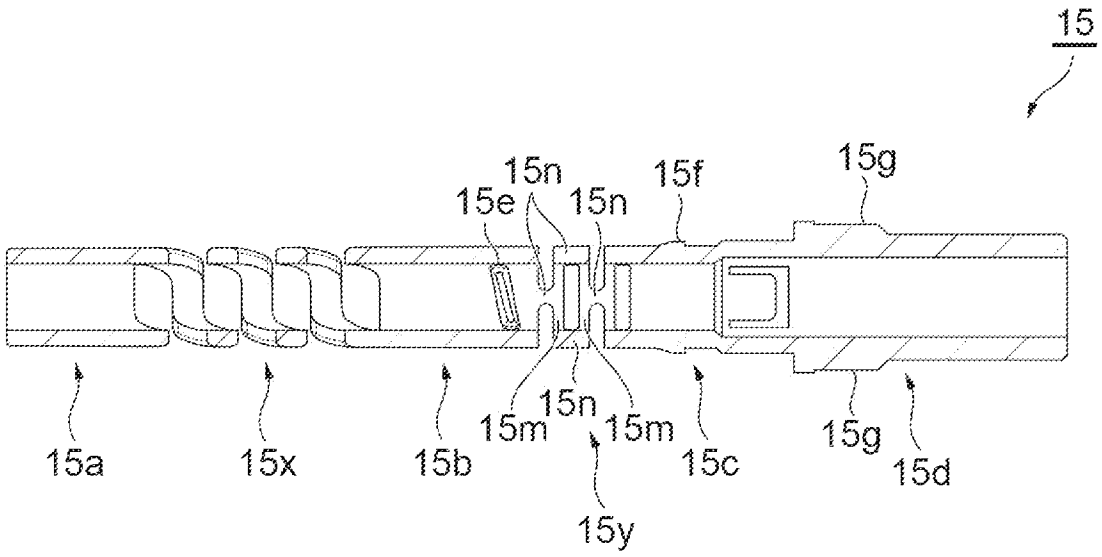
FIG. 20 is a cross-sectional view taken along a line XX-XX in FIG. 19.
Figure 21:
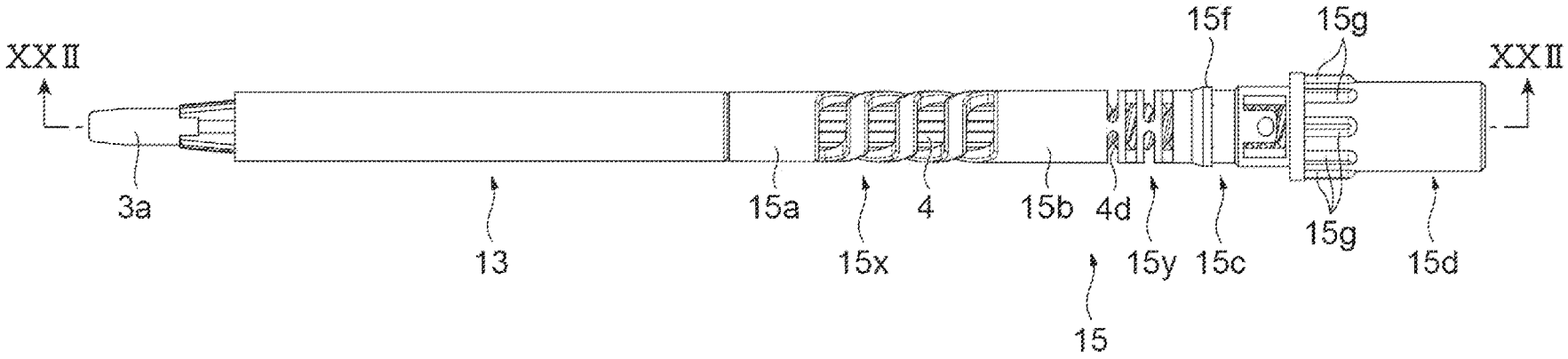
FIG. 21 is an assembled side view of the pipe member and the female screw member in FIG. 20.
Figure 22:
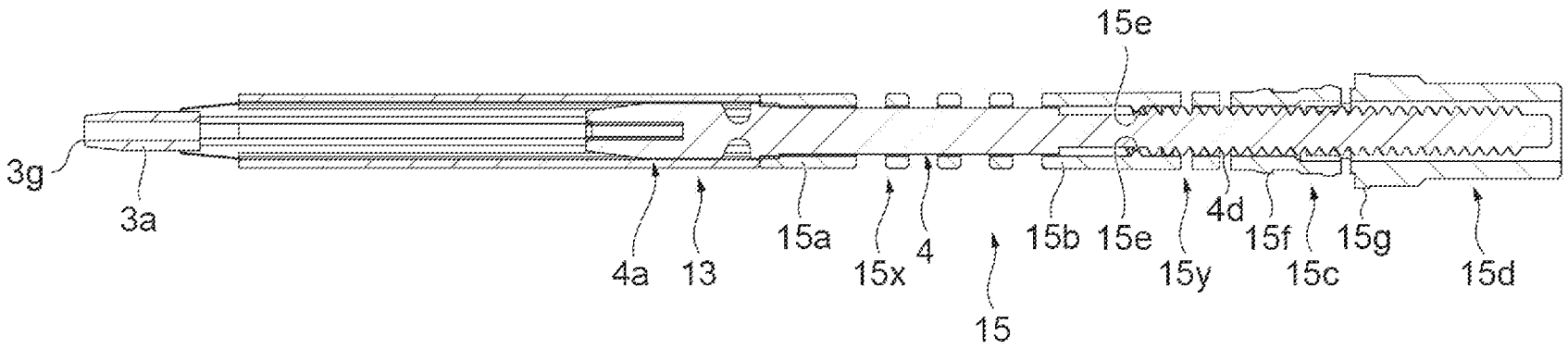
FIG. 22 is a cross-sectional view taken along a line XXII-XXII in FIG. 21.

FIG. 18 is a cross-sectional view illustrating a bar-shaped cosmetic material feeding container according to another example, FIGS. 19 and 20 illustrate a female screw member, and FIGS. 21 and 22 are assembled views of a pipe member and the female screw member.

A difference between a bar-shaped cosmetic material feeding container 300 according to another example and the bar-shaped cosmetic material feeding container 100 is that, instead of the female screw member 5 including the second spring 5*y*, as illustrated in FIGS. 19 and 20, a female screw member 15 including a first spring 15*x* and a second spring 15*y* is used, and accordingly, a front tube 11 and a pipe member 13 of which configuration is slightly changed instead of the front tube 1 and the pipe member 3 are used.

The female screw member 15 is integrally formed of a resin to be configured in a substantially cylindrical shape, and a front tube portion 15*a*, the first spring 15*x*, a screw tube portion 15*b*, the second spring 15*y*, a locking tube portion 15*c*, and a rear end portion 15*d* are provided in this order from the distal end side to the rear end side.

The first spring 15*x* is a spring having a slit on a peripheral surface and forming a substantially spiral shape to connect the front tube portion 15*a* and the screw tube portion 15*b*.

Screw protrusions 15*e* as female screws to be screwed with the male screw 4*d* of the moving body 4 are provided at positions facing the inner peripheral surface of the screw tube portion 15*b*, respectively.

The second spring 15*y* is configured by connecting a plurality of annular portions 15*m* aligned apart from each other in the axial direction by pairs of connecting portions 15*n* that extend along a short length in the axial direction, with the connecting portions 15*n* of each pair facing each other. A first pair of connecting portions 15*n* are arranged so as to be shifted by 90° around the axial line with respect to the positions of a second pair of connecting portions 15*n* that are adjacent to the first pair in the axial direction.

Due to the springs having such a configuration, the spring constant of the second spring 15*y* is greater than the spring constant of the first spring 15*x*.

On the outer peripheral surface of the locking tube portion 15*c*, an engaging convex portion 15*f* for engaging with the front tube 11 in the axial direction is provided in an annular shape.

The rear end portion 15*d* protrudes backward in the axial direction from the rear end of the front tube 11 and is picked by the user, and herein, a plurality of (eight in this case) ribs 15*g* provided side by side along the circumferential direction and extended along the axial direction are picked by the user to be prevented from sliding.

As illustrated in FIG. 18, in the front tube 11, the rear side of the stepped portion 1*a* illustrated in FIGS. 3 and 4 is elongated in the axial direction, and the convex portion 1*b* to be engaged with the container body 2 in the axial direction is removed. And, as illustrated in FIG. 18, an engaging concave portion 11*f* for being engaged with the engaging convex portion 15*f* of the female screw member 15 in the axial direction is provided in an annular shape. It is noted that the other shape of the front tube 11 is the same as that of the front tube 1 of the previously described bar-shaped cosmetic material feeding container 100.

As illustrated in FIGS. 21 and 22, in the pipe member 13, an elongated cylindrical portion 3*b* having a large diameter behind the distal end portion 3*a* illustrated in FIGS. 7 to 10 is shortened, and the flange portion 3*c* at the rear end is removed. It is noted that the other shape of the pipe member 13 is the same as that of the pipe member 3 of the bar-shaped cosmetic material feeding container 100.

Then, as illustrated in FIGS. 21 and 22, the core chuck 4*a* of the moving body 4 is inserted into the pipe member 13, and the distal end face of the front tube portion 15*a* of the female screw member 15 is allowed to abut on the rear end face of the pipe member 13. And, the screw protrusions 15*e* and 15*e* of the pipe member 13 are screwed with the male screw 4*d* of the moving body 4, this assembly is inserted into the front tube 11 as illustrated in FIG. 18, and the engaging convex portion 15*f* of the female screw member 15 is engaged with the engaging concave portion 11*f* of the front tube 11 in the axial direction. Therefore, the female screw member 15 is attached to the front tube 11 so as to be immovable in the axial direction and relatively rotatable around the axial line.

Then, the relative rotating portion (rear end portion) 15*d* protruding outward in the axial direction from the rear end of the front tube 11 of the female screw member 15 and relatively rotatable with the front tube 11 is picked by the user, and when the rib 15*g* is prevented from sliding and is relatively rotated in the feeding direction of the core chuck 4*a*, the bar-shaped cosmetic material M is fed.

Even in the bar-shaped cosmetic material feeding container 300 configured in this manner, similarly to the previously described bar-shaped cosmetic material feeding container 100, since the bar-shaped cosmetic material feeding container has the front tube 11 having the opening 1*c* provided at the distal end, the female screw member 15 provided with the screw protrusions 15*e* and 15*e* as the female screws inside of the female screw member and rotatable relative to the front tube 11, the moving body 4 provided with the male screw 4*d* capable being screwed with the screw protrusions 15*e* and 15*e* as the female screws of the female screw member 15 on the outer surface and provided with the core chuck 4*a* for gripping the bar-shaped cosmetic material M at the distal end, and the pipe member 13 arranged inside the front tube 11 to be movable in the axial direction with respect to the front tube 11 and rotatable synchronously around the axial line to protrude from the opening 1*c* of the front tube 11, wherein the moving body 4 is accommodated inside the pipe member 13 to be movable in the axial direction and rotatable synchronously around the axial line, and the opening 3*g* that allows the bar-shaped cosmetic material M to appear and disappear is provided at a distal end of the pipe member 13, and the bar-shaped cosmetic material feeding container has the first spring 15*x* buffering the pipe member 13 and the second spring 15*y* having a spring constants different from that the first spring 15*x* and buffering the core chuck 4*a*, a similar function and effect as those of the previously described bar-shaped cosmetic material feeding container 100 can be exhibited.

Further, since the spring constant of the second spring 15*y* is greater than the spring constant of the first spring 15*x*, the functions of the first spring 15*x* and the second spring 15*y* may be realized.

Further, since the first spring 15*x* and the second spring 15*y* are integrally formed with the female screw member 15, the number of components is further reduced as compared with the bar-shaped cosmetic material feeding container 100, described above.

Figure 23:
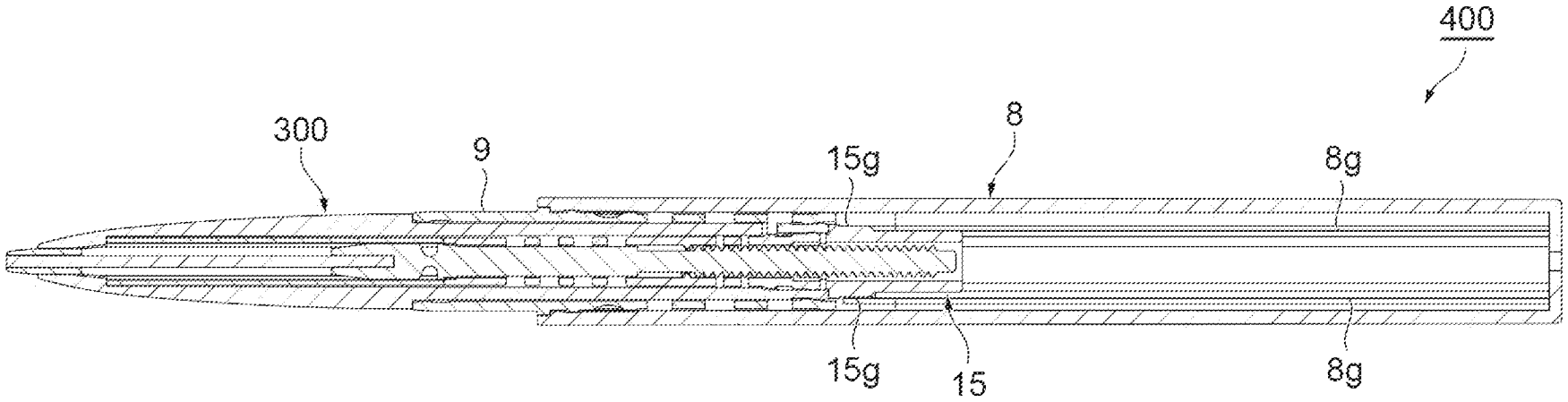
FIG. 23 is a cross-sectional view illustrating a bar-shaped cosmetic material feeding container according to another example.

FIG. 23 is a cross-sectional view illustrating a bar-shaped cosmetic material feeding container according to another example.

In a bar-shaped cosmetic material feeding container 400, the previously described bar-shaped cosmetic material feeding container 300 is used as a so-called bar-shaped cosmetic material cartridge, and the bar-shaped cosmetic material feeding container 400 is configured by attaching an elongated holder tube 8 having a bottomed cylindrical shape to the female screw member 15 through a spring member 9 that is expandable and contractible in the axial direction so as to be rotatable synchronously.

Specifically, on the inner peripheral surface of the holder tube 8, a plurality of ridges 8*g* provided side by side in a plurality of the equal distributions along the circumferential direction and extend with an elongated length from the bottom toward the distal end side are engaged with the ribs 15*g* constituting the relative rotating portion of the female screw member 15, so that the female screw member 15 and the holder tube 8 are rotatable synchronously.

According to the bar-shaped cosmetic material feeding container 400, similarly to the previously described bar-shaped cosmetic material feeding container 200, since drawing can be performed with the holder tube 8 held by hand, the usability with easier drawing can be achieved.

Figure 24:
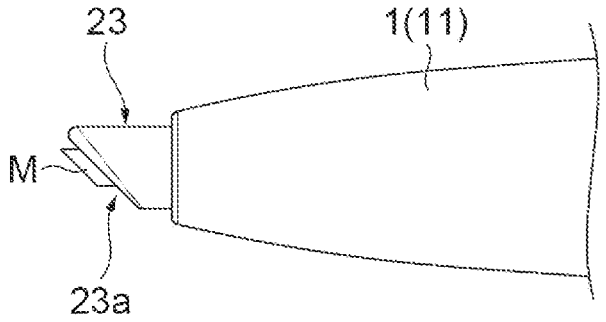
FIG. 24 is a side view illustrating a pipe member, a bar-shaped cosmetic material, and a distal end portion of a front tube of a bar-shaped cosmetic material feeding container according to another example.
Figure 25:
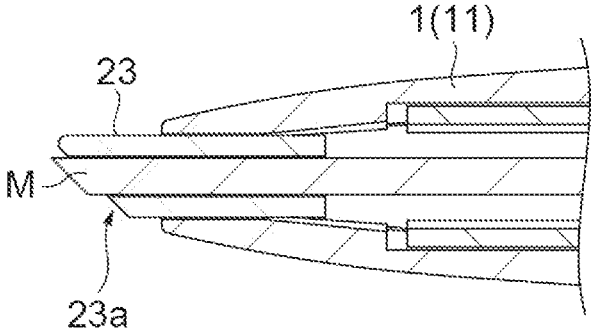
FIG. 25 is a cross-sectional view illustrating the pipe member, the bar-shaped cosmetic material, and the distal end portion of the front tube illustrated in FIG. 24.

FIG. 24 is a side view illustrating a pipe member, a bar-shaped cosmetic material, and a distal end portion of a front tube of a bar-shaped cosmetic material feeding container according to another example, and FIG. 25 is a cross-sectional view of FIG. 24.

A difference between the bar-shaped cosmetic material feeding container of the example of FIGS. 24 and 25 and the example bar-shaped cosmetic material feeding containers 100 to 400 is that, instead of the pipe members 3 and 13, a pipe member 23 has an inclined portion 23*a* where a distal end portion is inclined relative to the axial direction. Namely, the inclined portion (or front end surface) 23*a* is inclined relative to a radial plane that is orthogonal to the axial direction of the pipe member (or inner tube) 23. FIGS. 24 and 25 illustrate a bar-shaped cosmetic material M in a state of protruding from a distal end face of the pipe member 23.

With reference to FIGS. 24 and 25, when the bar-shaped cosmetic material feeding container faces the to-be coated portion at an angle, since the distal end portion of the pipe member 23 is an inclined portion 23*a*, the distal end of the bar-shaped cosmetic material M may more easily reach (or contact) the to-be coated portion, and a component force in the axial direction acts on the bar-shaped cosmetic material M. With this configuration, similarly to the case where the distal end portion perpendicular to the axial direction of the pipe member reaches the to-be coated portion, drawing can be performed while the bar-shaped cosmetic material M is appropriately retracted by the second spring 5*y* or 15*y*.

Figure 26:
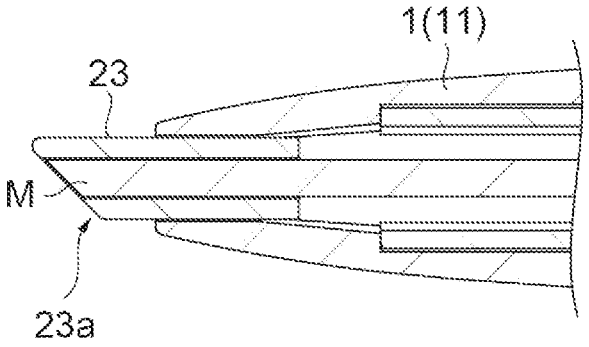
FIG. 26 is a cross-sectional view illustrating a pipe member, a bar-shaped cosmetic material, and a distal end portion of a front tube of a bar-shaped cosmetic material feeding container according to another example.

FIG. 26 is a cross-sectional view illustrating a pipe member, a bar-shaped cosmetic material, and a distal end portion of a front tube of a bar-shaped cosmetic material feeding container according to another example.

A difference between the bar-shaped cosmetic material feeding container of the example illustrated in FIG. 26 and the bar-shaped cosmetic material feeding container of the example of FIGS. 24 and 25 is that the bar-shaped cosmetic material M is flush with the distal end face of the pipe member.

With reference to FIG. 26, when the bar-shaped cosmetic material feeding container faces the to-be coated portion at an angle, since the distal end portion of the pipe member 23 is an inclined portion 23*a*, the distal ends of the bar-shaped cosmetic material M and the pipe member 23 may more easily reach (or contact) the to-be coated portion, and a component force in the axial direction acts on the bar-shaped cosmetic material M and the pipe member 23. With this configuration, similarly to the case where the distal end portion perpendicular to the axial direction of the pipe member reaches the to-be coated portion, drawing can be performed while the pipe member 23 is appropriately retracted by the first spring 6 or 15*x* and the bar-shaped cosmetic material M is appropriately retracted by the second spring 5*y* or 15*y*.

It is to be understood that not all aspects, advantages and features described herein may necessarily be achieved by, or included in, any one particular example. Indeed, having described and illustrated various examples herein, it should be apparent that other examples may be modified in arrangement and detail is omitted. For example, in the previously described bar-shaped cosmetic material feeding container 100, the first spring 6 is used as a coil spring, and the second spring 5*y* is used as a resin spring integrally formed with the female screw member 5. In addition, in the previously described bar-shaped cosmetic material feeding container 300, the first spring 15*x* and the second spring 15*y* are used as resin springs integrally formed with the female screw member 15. However, the first spring 6 may be used as a resin spring integrally formed with the female screw member 5, and the second spring 5*y* or 15*y* may be used as a coil spring. In short, at least one of the first spring and the second spring may be formed integrally with the female screw member 5 or 15. With such a configuration, the number of components can be reduced.

Further, the screw protrusion 5*a* or 15*e* may be a continuous female screw.

What is claimed is:

1. A bar-shaped cosmetic material feeding container comprising:

a front tube having a front end forming an opening;

an inner tube arranged inside the front tube, wherein the inner tube is rotatable synchronously with the front tube around a rotation axis of the bar-shaped cosmetic material feeding container, and movable in an axial direction relative to the front tube to move through the opening of the front tube, and wherein the inner tube has a first end that forms an opening to dispense the bar-shaped cosmetic material, and a second end opposite the first end in the axial direction;

a first spring to buffer a movement of the inner tube in the axial direction;

a screw member that is rotatable relative to the front tube;

a moving body that is accommodated inside the inner tube to rotate synchronously with the inner tube around the rotation axis and to move in the axial direction relative to the inner tube, wherein the moving body includes a core chuck for gripping the bar-shaped cosmetic material, and wherein the moving body is coupled to the screw member via a screw coupling to move the bar-shaped cosmetic material in the axial direction through the opening of the inner tube via a rotation of the moving body relative to the screw member; and a second spring to buffer a movement of the core chuck of the moving body in the axial direction, wherein the second spring has a spring constant different from a spring constant of the first spring, and wherein the first spring is located between the second end of the inner tube and the second spring in the axial direction.

2. The bar-shaped cosmetic material feeding container according to claim 1, further comprising a cylindrical container body that accommodates the screw member, wherein the container body is rotatable relative to the front tube, and synchronously rotatable with the screw member around the rotation axis.

3. The bar-shaped cosmetic material feeding container according to claim 1, wherein the screw member is at least partially accommodated in the front tube, and includes a rear end portion extending outwardly in the axial direction from a rear end of the front tube to drive the screw member into rotation relative to the front tube.

4. The bar-shaped cosmetic material feeding container according to claim 1, wherein at least one spring among the first spring and the second spring, is formed integrally with the screw member.

5. The bar-shaped cosmetic material feeding container according to claim 4, wherein both the first spring and the second spring having different spring constants, are formed integrally with the screw member.

6. The bar-shaped cosmetic material feeding container according to claim 1, wherein the spring constant of the second spring is greater than the spring constant of the first spring.

7. The bar-shaped cosmetic material feeding container according to claim 6, wherein at least one spring among the first spring and the second spring, is formed integrally with the screw member.

8. The bar-shaped cosmetic material feeding container according to claim 1, wherein the inner tube has a front end surface that forms the opening to dispense the bar-shaped cosmetic material, wherein the front end surface is inclined relative to a radial plane orthogonal to the axial direction.

9. The bar-shaped cosmetic material feeding container according to claim 1, further comprising a holder tube that accommodates a rear end of the front tube and a rear end of the screw member, wherein the holder tube is synchronously rotatable with the screw member.

10. The bar-shaped cosmetic material feeding container according to claim 9, wherein the holder tube has a rear end located opposite the front end of the front tube, in the axial direction, wherein the first spring is located between the second end of the inner tube and the rear end of the holder tube to buffer the movement of the inner tube, and wherein the second spring is located between the core chuck of the moving body and the rear end of the holder tube to buffer the movement of the core chuck.

11. The bar-shaped cosmetic material feeding container according to claim 10, wherein the first spring has a front end located adjacent to the inner tube, and a rear end located opposite the front end of the first spring in the axial direction, and wherein the second spring is located between the rear end of the first spring and the rear end of the holder tube.

12. The bar-shaped cosmetic material feeding container according to claim 1, wherein the screw member is a female screw member having a substantially tubular shape including an inner surface that forms a female screw thread, and wherein the moving body has an outer surface forming a male screw thread to engage with the female screw thread of the female screw member.

13. The bar-shaped cosmetic material feeding container according to claim 1, wherein the first spring is entirely offset in the axial direction from both the inner tube and the second spring.

14. The bar-shaped cosmetic material feeding container according to claim 1, wherein the first spring is spaced apart from the second spring in the axial direction.

15. The bar-shaped cosmetic material feeding container according to claim 1, wherein the screw member has an enlarged diameter portion having a greater diameter than a diameter of a portion of the screw member that extends along the first spring, wherein the enlarged diameter portion is located between the first spring and the second spring in the axial direction, and wherein the first spring has a front end that contacts the second end of the inner tube, and a rear end that contacts the enlarged diameter portion of the screw member.

16. The bar-shaped cosmetic material feeding container according to claim 1, wherein the first spring has a front end and a rear end opposite the front end of the first spring in the axial direction, the front end of the first spring being located between the second end of the inner tube and the rear end of the first spring, and wherein the second spring has a front end and a rear end opposite the front end of the second spring in the axial direction, the front end of the second spring being located between the rear end of the first spring and the rear end of the second spring.

* * * * *